US011203913B2

(12) United States Patent
Martin et al.

(10) Patent No.: US 11,203,913 B2
(45) Date of Patent: Dec. 21, 2021

(54) DOWNHOLE TOOL AND METHODS

(71) Applicant: INNOVEX DOWNHOLE SOLUTIONS, INC., Houston, TX (US)

(72) Inventors: Carl Martin, Houston, TX (US); Mark Reddout, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/818,502

(22) Filed: Mar. 13, 2020

(65) Prior Publication Data

US 2020/0291738 A1 Sep. 17, 2020

Related U.S. Application Data

(60) Provisional application No. 62/818,845, filed on Mar. 15, 2019.

(51) Int. Cl.
*E21B 33/128* (2006.01)
*E21B 33/129* (2006.01)
(Continued)

(52) U.S. Cl.
CPC ..... *E21B 33/128* (2013.01); *E21B 33/129* (2013.01); *E21B 23/04* (2013.01); *E21B 33/1208* (2013.01)

(58) Field of Classification Search
CPC .. E21B 33/128; E21B 33/1208; E21B 33/129; E21B 33/1277; E21B 23/04; E21B 34/06; E21B 43/103; E21B 2034/007
See application file for complete search history.

(56) References Cited

U.S. PATENT DOCUMENTS 2,189,697 A 2/1940 Baker
2,222,233 A 11/1940 Mize
(Continued)

FOREIGN PATENT DOCUMENTS

AR 091776 A1 2/2015
AU 2010214651 A1 3/2012
(Continued)

OTHER PUBLICATIONS

Anjum et al., Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way, SPE International Oil & Gas Conference, Jun. 8-10, 2010, pp. 1-16.
(Continued)

*Primary Examiner* — Yong-Suk (Philip) Ro
(74) *Attorney, Agent, or Firm* — MH2 Technology Law Group LLP

(57) ABSTRACT

A downhole tool includes an expandable sleeve. The expandable sleeve includes a lower portion and an upper portion. The downhole tool also includes a lower cone positioned at least partially within the lower portion of the expandable sleeve. The downhole tool also includes an upper cone positioned at least partially within the upper portion of the expandable sleeve. The lower and upper cones are configured to expand the respective lower and upper portions of the expandable sleeve radially outward when the lower and upper cones are adducted toward one another. The downhole tool also includes an isolation device extending through the bore of the expandable sleeve and positioned radially inward of the lower and upper cones. The isolation device is configured to engage the upper cone so as to block fluid flow therethrough in at least one direction.

19 Claims, 4 Drawing Sheets

(51) Int. Cl.
*E21B 33/12* (2006.01)
*E21B 23/04* (2006.01)

(56) References Cited

U.S. PATENT DOCUMENTS 2,225,143 A 12/1940 Baker et al.
3,127,198 A 3/1964 Orund
3,746,093 A 7/1973 Mullins
3,860,067 A 1/1975 Rodgers
4,155,404 A 5/1979 Hollingsworth
4,483,399 A 11/1984 Colgate
4,901,794 A 2/1990 Baugh et al.
5,064,164 A 11/1991 Le
5,131,468 A 7/1992 Lane et al.
5,325,923 A 7/1994 Surjaatmadja et al.
5,396,957 A 3/1995 Surjaatmadja et al.
5,479,986 A 1/1996 Gano et al.
5,542,473 A 8/1996 Pringle
5,623,993 A 4/1997 Buskirk et al.
5,701,959 A 12/1997 Hushbeck et al.
5,709,269 A 1/1998 Head
5,984,007 A 11/1999 Yuan et al.
6,167,963 B1 1/2001 McMahan et al.
6,220,349 B1 4/2001 Vargus et al.
6,296,054 B1 10/2001 Kunz et al.
6,354,372 B1 3/2002 Carisella et al.
6,354,373 B1 3/2002 Vercaemer et al.
6,446,323 B1 9/2002 Metcalfe et al.
6,581,681 B1 6/2003 Zimmerman et al.
6,662,876 B2 12/2003 Lauritzen
6,684,958 B2 2/2004 Williams et al.
6,695,050 B2 2/2004 Winslow et al.
6,702,029 B2 3/2004 Metcalfe et al.
6,712,153 B2 3/2004 Turley et al.
6,722,437 B2 4/2004 Vercaemer et al.
6,793,022 B2 9/2004 Vick et al.
6,796,376 B2 9/2004 Frazier
6,796,534 B2 9/2004 Beyer et al.
7,048,065 B2 5/2006 Badrak et al.
7,093,656 B2 8/2006 Maguire
7,096,938 B2 8/2006 Carmody et al.
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Hailey, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,614,448 B2 11/2009 Swagerty et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
7,980,300 B2 7/2011 Roberts et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,776 B2 3/2015 Spray
8,991,485 B2 3/2015 Chenault et al.
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,228,404 B1 1/2016 Jackson et al.
9,309,733 B2 4/2016 Xu et al.
9,334,702 B2 5/2016 Allen et al.
9,382,790 B2 7/2016 Bertoja et al.
D762,737 S 8/2016 Fitzhugh
D763,324 S 8/2016 Fitzhugh
9,470,060 B2 10/2016 Young
9,574,415 B2 2/2017 Xu et al.
9,605,508 B2 3/2017 Xu et al.
D783,133 S 4/2017 Fitzhugh
9,752,423 B2 9/2017 Lynk
9,835,003 B2 12/2017 Harris
D807,991 S 1/2018 Fitzhugh
9,909,384 B2 3/2018 Chauffe et al.
9,927,058 B2 3/2018 Sue
9,976,379 B2 5/2018 Schmidt
9,976,381 B2 5/2018 Martin et al.
D827,000 S 8/2018 Van Lue
10,156,119 B2 12/2018 Martin et al.
10,400,531 B2 9/2019 Jackson et al.
10,408,012 B2 9/2019 Martin et al.
10,415,336 B2 9/2019 Benzie
10,533,392 B2 1/2020 Walton
10,605,018 B2 3/2020 Schmidt
10,648,275 B2 5/2020 Dirocco
10,920,523 B2 2/2021 Kellner et al.
2003/0062171 A1 4/2003 Maguire et al.
2003/0099506 A1 5/2003 Mosing
2003/0188876 A1 10/2003 Vick et al.
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.

(56) References Cited

U.S. PATENT DOCUMENTS

2005/0189103 A1 9/2005 Roberts et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.
2006/0272828 A1 12/2006 Manson
2007/0000664 A1 1/2007 Ring et al.
2007/0044958 A1 3/2007 Rytlewski et al.
2007/0272418 A1 11/2007 Corre et al.
2008/0066923 A1 3/2008 Xu
2008/0073074 A1 3/2008 Frazier
2008/0135248 A1 6/2008 Talley et al.
2008/0135261 A1 6/2008 McGilvray et al.
2008/0142223 A1 6/2008 Xu et al.
2008/0190600 A1 8/2008 Shkurti et al.
2008/0264627 A1 10/2008 Roberts et al.
2008/0308266 A1 12/2008 Roberts et al.
2009/0044949 A1 2/2009 King et al.
2009/0065192 A1 3/2009 Lucas
2009/0065196 A1 3/2009 Holland et al.
2009/0205843 A1 8/2009 Gandikota et al.
2009/0242213 A1 10/2009 Braddick
2009/0266560 A1 10/2009 Ring et al.
2010/0032167 A1 2/2010 Adam et al.
2010/0038072 A1 2/2010 Akselberg
2010/0116489 A1 5/2010 Nelson
2010/0132960 A1 6/2010 Shkurti et al.
2010/0170682 A1 7/2010 Brennan, III
2010/0263857 A1 10/2010 Frazier
2010/0270031 A1 10/2010 Patel
2010/0270035 A1 10/2010 Ring et al.
2010/0276159 A1 11/2010 Mailand et al.
2010/0314127 A1 12/2010 Swor et al.
2010/0319427 A1 12/2010 Lohbeck
2010/0319927 A1 12/2010 Yokley et al.
2011/0005779 A1 1/2011 Lembcke
2011/0048743 A1 3/2011 Stafford et al.
2011/0088891 A1 4/2011 Stout
2011/0132143 A1 6/2011 Xu et al.
2011/0132619 A1 6/2011 Agrawal et al.
2011/0132621 A1 6/2011 Agrawal et al.
2011/0132623 A1 6/2011 Moeller
2011/0232899 A1* 9/2011 Porter ..... E21B 33/1292 166/181
2011/0240295 A1 10/2011 Porter et al.
2011/0266004 A1 11/2011 Hallundbaek et al.
2011/0284232 A1 11/2011 Huang
2012/0024109 A1 2/2012 Xu et al.
2012/0055669 A1 3/2012 Levin et al.
2012/0067583 A1 3/2012 Zimmerman et al.
2012/0097384 A1 4/2012 Valencia
2012/0111566 A1 5/2012 Sherman et al.
2012/0118583 A1 5/2012 Johnson et al.
2012/0132426 A1 5/2012 Xu et al.
2012/0168163 A1 7/2012 Bertoja et al.
2012/0199341 A1 8/2012 Kellner et al.
2012/0205873 A1 8/2012 Turley
2012/0247767 A1 10/2012 Themig et al.
2012/0273199 A1 11/2012 Cresswell et al.
2013/0008671 A1 1/2013 Booth
2013/0062063 A1 3/2013 Baihly et al.
2013/0081825 A1 4/2013 Lynde et al.
2013/0186615 A1 7/2013 Hallubaek et al.
2013/0186616 A1 7/2013 Xu et al.
2013/0192853 A1 8/2013 Themig
2013/0299185 A1 11/2013 Xu et al.
2014/0014339 A1 1/2014 O'Malley et al.
2014/0076571 A1 3/2014 Frazier et al.
2014/0131054 A1 5/2014 Raynal
2014/0209325 A1 7/2014 Dockweiler
2014/0224477 A1 8/2014 Wiese
2014/0238700 A1 8/2014 Williamson
2014/0262214 A1 9/2014 Mhaskar
2014/0352970 A1 12/2014 Kristoffer
2015/0027737 A1 1/2015 Rochen
2015/0068757 A1 3/2015 Hofman et al.
2015/0075774 A1 3/2015 Raggio
2015/0129215 A1 5/2015 Xu et al.
2015/0184485 A1 7/2015 Xu et al.
2015/0218904 A1 8/2015 Chauffe et al.
2016/0160591 A1 6/2016 Xu
2016/0186511 A1 6/2016 Coronado et al.
2016/0290096 A1 10/2016 Tse
2016/0305215 A1 10/2016 Harris et al.
2016/0312557 A1 10/2016 Kitzman
2016/0333655 A1 11/2016 Fripp
2016/0376869 A1 12/2016 Rochen
2017/0022781 A1 1/2017 Martin
2017/0067328 A1 3/2017 Chauffe
2017/0101843 A1 4/2017 Waterhouse et al.
2017/0130553 A1 5/2017 Harris
2017/0146177 A1 5/2017 Sue
2017/0218711 A1 8/2017 Kash
2017/0260824 A1 9/2017 Kellner
2017/0370176 A1 12/2017 Frazier
2018/0030807 A1 2/2018 Martin
2018/0073325 A1 3/2018 Dolog
2018/0087345 A1 3/2018 Xu
2018/0266205 A1 9/2018 Martin
2018/0363409 A1 12/2018 Frazier
2019/0063179 A1 2/2019 Murphy
2019/0106961 A1 4/2019 Hardesty
2019/0203556 A1 7/2019 Powers
2019/0264513 A1 8/2019 Kosel
2019/0292874 A1 9/2019 Saeed
2020/0072019 A1 3/2020 Tonti
2020/0131882 A1 4/2020 Tonti
2020/0173246 A1 6/2020 Kellner
2020/0248521 A1 8/2020 Southard
2020/0256150 A1 8/2020 Kellner

FOREIGN PATENT DOCUMENTS

EP 2251525 A1 11/2010
GB 2345308 A 7/2000
GB 2448449 A 10/2008
GB 2448449 B 12/2008
GB 2482078 A 1/2012
WO 2010/039131 A1 4/2010
WO 2011/023743 A2 11/2011
WO 2011/137112 A2 11/2011
WO 2014/014591 A1 1/2014
WO 2014/100072 A1 6/2014
WO 2016/160003 A1 10/2016
WO 2017/151384 A1 9/2017

OTHER PUBLICATIONS

Chakraborty et al., Drilling and Completions Services and Capabilities Presentation, Jan. 2018, Virtual Integrated Analytic Solutions, Inc., 33 pages.
Gorra et al., Expandable Zonal Isolation Barrier (ZIB) Provides a Long-Term Well Solution as a High Differential Pressure Metal Barrier to Flow, Brazilian Petroleum Technical Papers, 2010, Abstract only, 1 page.
Hinkie et al., Multizone Completion with Accurately Placed Stimulation Through Casing Wall, SPE Production and Operations Symposium, Mar. 13-Apr. 3, 2007, pp. 1-4.
Jackson et al., Slip Assembly, U.S. Appl. No. 13/361,477, filed Jan. 30, 2012.
Jackson et al., Slip Assembly, U.S. Appl. No. 14/987,255, filed Jan. 4, 2016.
Kellner et al., Downhole Tool Including a Swage, U.S. Appl. No. 29/689,996, filed May 3, 2019.
Kellner et al., Slip Segment for a Downhole Tool, U.S. Appl. No. 15/064,312, filed Mar. 8, 2016.
Kellner et al., Ball Drop Wireline Adapter Kit, U.S. Appl. No. 16/131,802, filed Sep. 14, 2018.
Kellner et al., Downhole Tool With Ball-In-Place Setting Assembly and Asymmetric Sleeve, U.S. Appl. No. 16/366,470, filed Mar. 27, 2019.

(56) References Cited

OTHER PUBLICATIONS

Kellner et al., Downhole Tool With Sleeve and Slip, U.S. Appl. No. 16/804,765, filed Feb. 28, 2020.
Kellner et al., Downhole Tool With Sealing Ring, U.S. Appl. No. 16/695,316, filed Nov. 11, 2019.
King et al., A Methodology for Selecting Interventionless Packer Setting Techniques, SPE-90678-MS, Society of Petroleum Engineers, 2004, pp. 1-3.
Larimore et al., Overcoming Completion Challenges with Interventionless Devices—Case Study—The "Disappearing Plug", SPE 63111, SPE International 2000, pp. 1-13.
Mailand et al., Non-Damaging Slips and Drillable Bridge Plug, U.S. Appl. No. 12/836,333, filed Jul. 14, 2010.
Martin et al., Downhole Tool With an Expandable Sleeve, U.S. Appl. No. 15/217,090, filed Jul. 22, 2016.
Martin et al., Downhole Tool With an Expandable Sleeve, U.S. Appl. No. 15/727,390, filed Oct. 6, 2017.
Martin et al., Downhole Tool With an Expandable Sleeve, U.S. Appl. No. 15/985,637, filed May 21, 2018.
Kellner et al., Deformable Downhole Tool With Dissolvable Element and Brittle Protective Layer, U.S. Appl. No. 16/677,993, filed Nov. 8, 2019.
Tonti et al., Downhole Tool With an Expandable Sleeve, Grit Material, and Button Inserts, U.S. Appl. No. 16/117,089, filed Aug. 30, 2018.
Tonti et al., Downhole Tool With Recessed Buttons, U.S. Appl. No. 16/662,792, filed Oct. 24, 2019.
Tonti, Downhole Tool With an Acid Pill, U.S. Appl. No. 17/178,517, filed Feb. 18, 2021.
Vargus et al., Completion System Allows for Interventionless Stimulation Treatments in Horizontal Wells with Multiple Shale Pay Zones, Annual SPE Technical Conference, Sep. 2008, Abstract only, 1 page.
Vargus et al., Completion System Allows for Interventionless Stimulation Treatments in Horizontal Wells with Multiple Shale Pay Zones, SPE Annual Technical Conference, Sep. 2008, pp. 1-8.
Vargus et al., System Enables Multizone Completions, The American Oil & Gas Reporter, 2009, Abstract only, 1 page.
World Oil, Slotted Liner Design for SAGD Wells ///, Jun. 2007, WorldOil.Com, https://www.worldoil.com/magazine/2007/june-2007/special-focus/slotted-liner-design-for-sagd-wells, 1 page.
Xu et al., Declaration Under 37 CFR 1.132, U.S. Appl. No. 14/605,365, filed Jan. 26, 2015, pp. 1-4.
Xu et al., Smart Nanostructured Materials Deliver High Reliability Completion Tools for Gas Shale Fracturing, SPE 146586, SPE International, 2011, pp. 1-6.
Zhang et al., High Strength Nanostructured Materials and Their Oil Field Applications, SPE 157092, SPE International, 2012, pp. 1-6.
Non-Final Office Action dated Apr. 15, 2021, U.S. Appl. No. 16/804,765, 13 pages.

* cited by examiner

DOWNHOLE TOOL AND METHODS

CROSS-REFERENCE TO RELATED APPLICATIONS

This patent application claims priority to Provisional Patent Application No. 62/818,845, filed on Mar. 15, 2019, the entirety of which is incorporated by reference herein.

BACKGROUND

Plugs, such as bridge plugs and frac plugs, are downhole tools that are conventionally used to permanently or temporarily isolate wellbore zones from one another. Such isolation is often necessary to pressure test, perforate, frac, or stimulate a zone of the wellbore without impacting or communicating with other zones within the wellbore. To reopen and/or restore fluid communication through the wellbore, the plugs are typically removed or otherwise compromised.

Drop-ball plugs, sometimes also referred to as frac plugs, enable temporary blocking of fluid flow in one direction (e.g., in the downhole direction), while allowing fluid flow in the other direction. While drop-ball plugs have proven to be effective, pumping the drop balls from the surface, through the wellbore, and to the seat of the plug can be time-consuming and expensive. For example, wells having long horizontal sections require a large amount of water to pump the ball down to the plug. The water (or other fluids) needed to pump the ball through the wellbore and to the plug is thus considered part of the cost of the plug, and can make the plugs less economically viable than other options.

SUMMARY

A downhole tool is disclosed. The downhole tool includes an expandable sleeve. The expandable sleeve includes a lower portion and an upper portion. The downhole tool also includes a lower cone positioned at least partially within the lower portion of the expandable sleeve. The downhole tool also includes an upper cone positioned at least partially within the upper portion of the expandable sleeve. The lower and upper cones are configured to expand the respective lower and upper portions of the expandable sleeve radially outward when the lower and upper cones are adducted toward one another. The downhole tool also includes an isolation device extending through the bore of the expandable sleeve and positioned radially inward of the lower and upper cones. The isolation device is configured to engage the upper cone so as to block fluid flow therethrough in at least one direction.

In another embodiment, the downhole tool includes an expandable sleeve. The expandable sleeve includes a lower portion and an upper portion. The downhole tool also includes a lower cone and an upper cone positioned at least partially within the lower portion of the expandable sleeve. The downhole tool also includes an isolation device extending through the expandable sleeve, the lower cone, and the upper cone. The isolation device is configured to contact the lower cone, the upper cone, or both to cause the expandable sleeve to expand radially outward. Fluid flow through the expandable sleeve is permitted when the isolation device is in contact with the lower cone. Fluid flow through the expandable sleeve is substantially prevented when the isolation device is in contact with the upper cone.

A method for plugging a wellbore is also disclosed. The method includes running a downhole tool into the wellbore in a first state. The downhole tool includes an expandable sleeve. The downhole tool also includes a lower cone and an upper cone positioned at least partially within the expandable sleeve. The downhole tool also includes an isolation device extending through the expandable sleeve, the lower cone, and the upper cone. The method also includes actuating the downhole tool into a second state in the wellbore. Actuating the downhole tool into the second state includes adducting the lower and upper cones toward one another in the expandable sleeve, thereby causing the expandable sleeve to expand radially outward. The method further includes increasing a pressure of a fluid in the wellbore above the downhole tool when the downhole tool is in the second state, thereby causing the isolation device to engage the upper cone and substantially prevent fluid flow though the downhole tool in a downhole direction.

BRIEF DESCRIPTION OF THE DRAWINGS

The accompanying Figures, which are incorporated in and constitute a part of this specification, illustrate embodiments of the present teachings and together with the description, serve to explain the principles of the present teachings. In the Figures.

Figure 1:
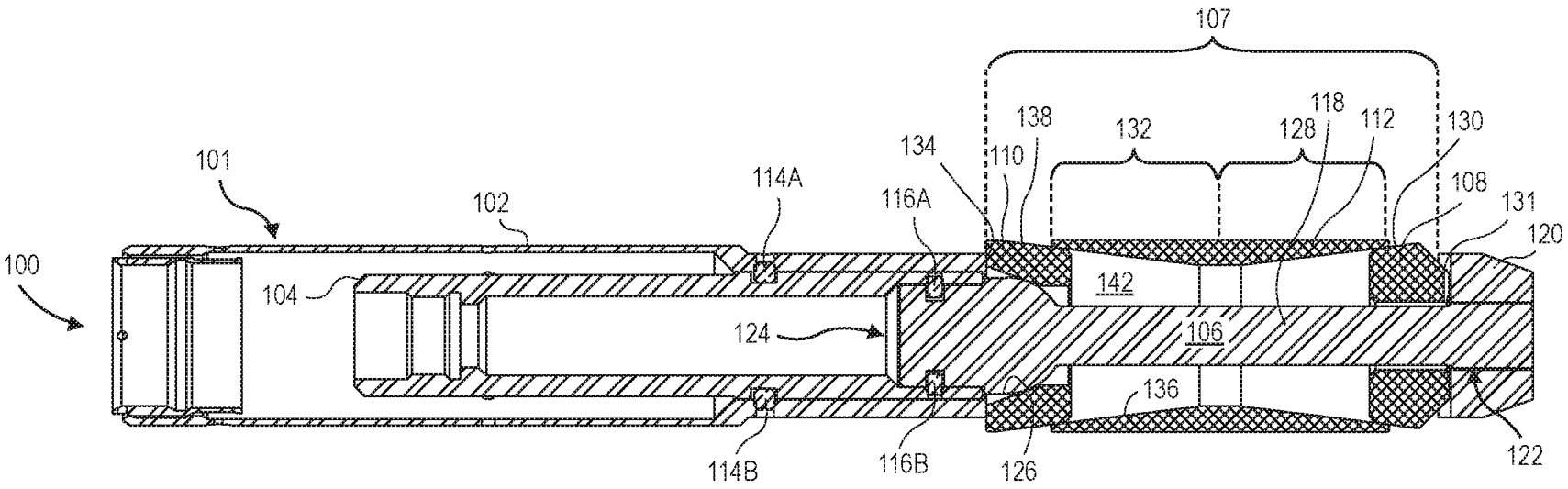
FIG. 1 illustrates a cross-sectional side view of a downhole tool in a first (e.g., run-in) state, according to an embodiment.

It should be noted that some details of the Figure have been simplified and are drawn to facilitate understanding of the embodiments rather than to maintain strict structural accuracy, detail, and scale.

DETAILED DESCRIPTION

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one embodiment may be used in any other embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional side view of a downhole tool 100 in a first (e.g., run-in) state, according to an embodiment. The downhole tool 100 may include a setting tool 101 having a setting sleeve 102 and an inner body 104 at least partially disposed within the setting sleeve 102. The downhole tool 100 may also include an isolation device (e.g., a "dart") 106 coupled to the inner body 104.

The downhole tool 100 may include a plug 107 having a first body (also referred to as a lower cone) 108, a second body (also referred to as an upper cone) 110, and a generally cylindrical, expandable sleeve 112. As further described herein, the cones 108, 110 may provide swages that serve to expand the expandable sleeve 112 (e.g., deform the expandable sleeve 112 radially outwards) as the cones 108, 110 are moved toward one another and/or relative to the expandable sleeve 112 during setting.

As illustrated in FIG. 1, the setting sleeve 102 may be coupled to the inner body 104 via one or more shearable members, e.g., shear pins (two are shown: 114A, 114B). The shearable members 114A, 114B may be coupled to and/or positioned at least partially within recesses in the setting sleeve 102, the inner body 104, or both. The shearable members 114A, 114B may thus temporarily couple the setting sleeve 102 and the inner body 104 with one another. As further illustrated in FIG. 1, the inner body 104 may similarly be coupled to the isolation device 106 via one or more shearable members, e.g., shear pins (two are shown: 116A, 116B). The shearable members 116A, 116B may be coupled to and/or positioned at least partially within recesses in the inner body 104, the isolation device 106, or both.

The isolation device 106 may include a shaft 118 extending through the upper cone 110, the expandable sleeve 112, and the lower cone 108. Further, the isolation device 106 may include a head 120 coupled to or integral with a first (e.g., lower) end portion 122 of the shaft 118. As illustrated in FIG. 1, the head 120 may be a generally annular body coupled to the first end portion 122 of the shaft 118. For example, the head 120 may be a nut that is screwed onto the shaft 118 or a cap that is otherwise fixed thereto. In at least one embodiment, the annular body of the head 120 may define one or more channels or grooves 121 (see FIG. 4) extending therethrough. As discussed below, the channels or grooves 121 may be capable of or configured to allow fluid communication through the isolation device 106 and/or between the isolation device 106 and the lower cone 108.

A second (e.g., upper) end portion 124 of the isolation device 106 may be sized and/or shaped to interface with the upper cone 110. For example, as illustrated in FIG. 1, the second end portion 124 of the isolation device 106 may be sized and/or shaped to interface with a tapered inner surface of the upper cone 110 forming a valve seat 126. For example, the inner surface of the upper cone 110 forming the valve seat 126 and/or the second end portion 124 of the isolation device 106 may be curved, arcuate, angled, flat angled, spherical, semispherical, hemispherical, or the like. As such, when the valve seat 126 and the second end portion 124 are engaged or interfaced with one another, a fluid tight seal is formed therebetween. In at least one embodiment, an annular body may be coupled to the second end portion 124 of shaft 118, and the annular body may be sized and/or shaped (e.g., curved, arcuate, angled, flat angled, spherical, semispherical, hemispherical, etc.) to interface with the valve seat 126 of the upper cone 110. While the second end portion 124 of the isolation device 106 is illustrated as having a curved or semispherical shape, it should be appreciated that any shape capable of forming a fluid tight seal with the valve seat 126 is contemplated.

The lower cone 108 may be at least partially positioned within a lower axial portion 128 of the expandable sleeve 112. An outer surface 130 of the lower cone 108 may be tapered such that an outer diameter of the outer surface 130 of the lower cone 108 decreases proceeding toward an upper axial end of the lower cone 108. As such, the outer surface 130 of the lower cone 108 may be oriented at an acute angle with respect to a central longitudinal axis extending through the downhole tool 100. In at least one embodiment, the annular ring of the lower cone 108 may define one or more channels or grooves 131 extending therethrough. For example, as illustrated in FIG. 1, an axial surface of the annular ring of the lower cone 108 may define one or more channels or grooves 131 extending radially therethrough. The one or more channels or grooves 131 may be capable of or configured to allow fluid communication through the lower cone 108 and/or between interfacing surfaces of the lower cone 108 and the isolation device 106.

The upper cone 110 may be disposed adjacent to the second end portion 124 of the isolation device 106 such that the valve seat 126 of the upper cone 110 engages the second end portion 124 of the isolation device 106. The valve seat 126 may be tapered such that an outer diameter of the upper cone 110 decreases proceeding toward a lower axial end of the upper cone 110. The upper cone 110 may also be positioned at least partially within an upper axial portion 132 of the expandable sleeve 112. The upper cone 110 may also be positioned adjacent to a lower axial end 134 of the setting sleeve 102. For example, as illustrated in FIG. 1, an upper axial end of the upper cone 110 may be positioned adjacent to or abut (e.g., directly or indirectly) a shoulder or the lower axial end 134 of the setting sleeve 102. In another embodiment, the setting sleeve 102 and the upper cone 110 may form a tapered engagement therebetween (not shown).

The outer surface 130 of the lower cone 108 and/or an inner surface 136 of the expandable sleeve 112 may be provided with a high-friction coating, such as a grit. In some embodiments, the grit may be provided as a thermal-spray metal, such as WEARSOX®, for example, as disclosed in U.S. Pat. No. 7,487,840, and/or U.S. Patent Publication No. 2015/0060050, which are incorporated by reference herein. Alternatively or additionally, the outer surface 130 and/or the inner surface 136 may be provided with teeth, buttons, or a ratcheting mechanism. The function of such coating, teeth, buttons, and/or ratcheting mechanism may be to maintain the position of the lower cone 108 relative to the expandable sleeve 112, so as to resist the lower cone 108 being pushed out of a bore 142 of the expandable sleeve 112 when the downhole tool 100 is in a set (e.g., expanded) state. An outer surface 138 of the upper cone 110 may include a similar coating, grit, buttons, teeth, ratcheting mechanism, etc., to resist movement of the upper cone 110 relative to the expandable sleeve 112 when the downhole tool 100 is in the set state.

As briefly discussed above, the expandable sleeve 112 may include the upper axial portion 132 and the lower axial portion 128. One or both of the upper and lower axial portions 128, 132 may be tapered, such that a thickness thereof varies along respective axial lengths thereof. For example, an inner diameter of the expandable sleeve 112 defining the upper axial portion 132 may decrease as proceeding toward the lower axial end 128 of the expandable sleeve 112, while an outer diameter 140 may remain generally constant. In another example, the inner diameter of the expandable sleeve 112 defining the lower axial portion 128 may decrease as proceeding toward the upper axial portion 132, while the outer diameter 140 remains generally constant. Accordingly, in some embodiments, an inner surface 136 of the expandable sleeve 112 may be oriented at one or more angles with respect to a central longitudinal axis extending through the downhole tool 100. For example, a first portion of the inner surface 136 forming the upper axial portion 132 of the expandable sleeve 112 may be oriented at a first angle relative to the central longitudinal axis of the downhole tool 100, and a second portion of the inner surface 136 forming the lower axial portion 128 of the expandable sleeve 112 may be oriented at a second angle relative to the central longitudinal axis of the downhole tool 100. The first and second angles may each be acute angles; for example, from about 5° to about 20°, about 10° to about 30°, or about 15° to about 40°, relative to the central longitudinal axis of the downhole tool 100.

In some embodiments, the outer surface 140 of the expandable sleeve 112 may form a high-friction interface with a surrounding surface (e.g., a surface of the wellbore wall, liner, casing, etc.) with sufficient friction to avoid axial displacement of the expandable sleeve 112 with respect to the surrounding surface. In an embodiment, the outer surface 140 may be applied with, impregnated with, or otherwise include grit. For example, such grit may be provided by a carbide material. Illustrative materials on the outer surface 140 of the expandable sleeve 112 may be found in U.S. Pat. No. 8,579,024, which is incorporated by reference herein. In some embodiments, the grit may be provided as a thermal-spray metal, such as WEARSOX®, for example, as disclosed in U.S. Pat. No. 7,487,840, and/or U.S. Patent Publication No. 2015/0060050. In other embodiments, the outer surface 140 may include teeth, buttons, and/or wickers designed to bite into (e.g., partially embed in) another material.

In at least one embodiment, any one or more portions or components of the plug 107 may be fabricated from a material capable of or configured to be dissolvable. For example, the plug 107 and/or one or more components thereof, including the expandable sleeve 112 and the first and second cones 108, 110, may be fabricated from a material capable of or configured to be dissolvable when exposed to a chemical solution, an ultraviolet light, a nuclear source, or any combination thereof within a predetermined time (e.g., less than 1 week, less than 1 day, or less than one hour). Illustrative materials may be or include, but are not limited to, an epoxy resin, a fiberglass, a metal, such as magnesium, aluminum, tin, an alloy thereof, or any combination thereof.

In the run-in state, illustrated in FIG. 1, the cones 108, 110 may be disposed proximal to the lower and upper axial ends 128, 132 of the expandable sleeve 112 (e.g., at least partially disposed within the expandable sleeve 112). The shaft 118 of the isolation device 106 may also be received through the cones 108, 110 and the expandable sleeve 112. As described below, the expandable sleeve 112 may be configured to set in a surrounding tubular member (e.g., a liner, a casing, a wall of a wellbore, etc.) when expanded by adduction of the first and second cones 108, 110.

In operation, the downhole tool 100 may be deployed into and positioned within a wellbore in the run-in state, as shown in FIG. 1. As illustrated in FIG. 1, in the run-in state, the expandable sleeve 112 may be in an unactuated state where the outer surface 140 thereof is unexpanded, and thus not engaged with the surrounding tubular in the wellbore.

Figure 2:
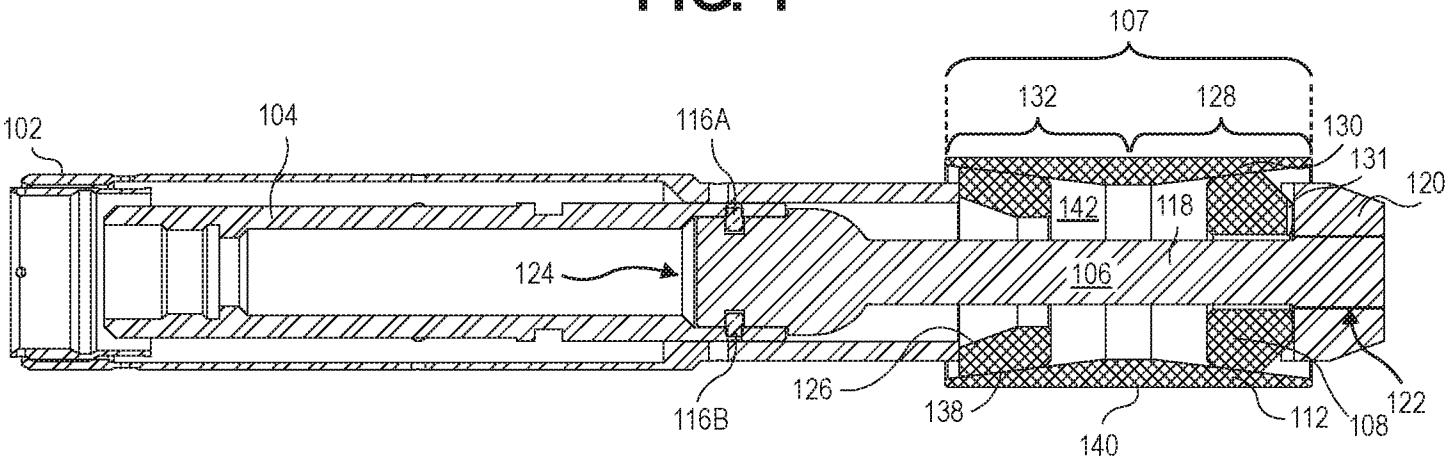
FIG. 2 illustrates a cross-sectional side view of the downhole tool in a second (e.g., set) state, according to an embodiment.

After the downhole tool 100 is positioned within the wellbore, the upper and lower cones 108, 110 may be moved towards one another and/or relative to the expandable sleeve 112 to expand the expandable sleeve 112 radially outward into a second (e.g., set) state, as shown in FIG. 2.

To move the upper and lower cones 108, 110 towards one another, the inner body 104 and the isolation device 106 coupled therewith may be moved in an uphole direction (to the left in FIG. 2) relative to the setting sleeve 102. In order for such movement to occur, a downward force is applied on the setting sleeve 102 (to the right in FIG. 2), while an upward force is applied on the inner body 104, resulting in the shearable members 114A, 114B shearing. Continued application of the opposing upward and downward forces causes the inner body 104 and the isolation device 106 coupled therewith to move in the uphole direction such that the head 120 of the isolation device 106 abuts and applies an axially-directed force to the lower cone 108 to move the lower cone 108 upward, toward the upper cone 110 (to the left in FIG. 2). The movement of the lower cone 108 towards the upper cone 110 causes the lower axial portion 128 of the expandable sleeve 112 to expand radially outward towards the wellbore. At the same time, the downward force on the setting sleeve 102 pushes the upper cone 110 downward, into the expandable sleeve 112. The movement of the upper cone 110 towards the lower cone 108 causes the upper axial portion 132 of the expandable sleeve 112 to expand radially outward towards the wellbore.

Figure 3:
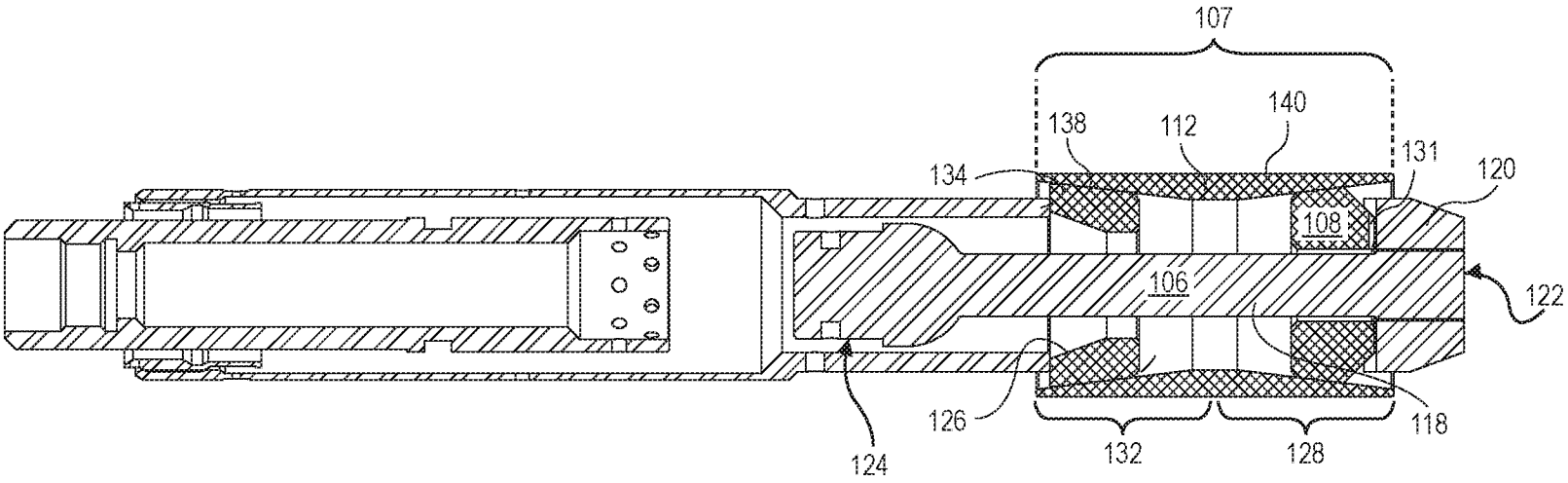
FIG. 3 illustrates a cross-sectional view of the downhole tool in the set state after decoupling an inner body and an isolation device from one another, according to an embodiment.

After the downhole tool 100 is actuated into the set state, the inner body 104 and the isolation tool 106 may be decoupled from one another, as shown in FIG. 3. To decouple the inner body 104 and the isolation tool 106 from one another, the inner body 104 may be moved in the uphole direction (to the left in FIG. 3), while the head 120 engages the lower cone 108, with a force sufficient to shear the shearable members 116A, 116B coupling the inner body 104 with the isolation device 106. After decoupling the inner body 104 from the isolation device 106, the setting sleeve 102 and the inner body 104 may be removed or pulled out of the wellbore. In at least one embodiment, the shearable members 114A, 114B may shear under a lesser force than the shearable members 116A, 116B.

Figure 4:
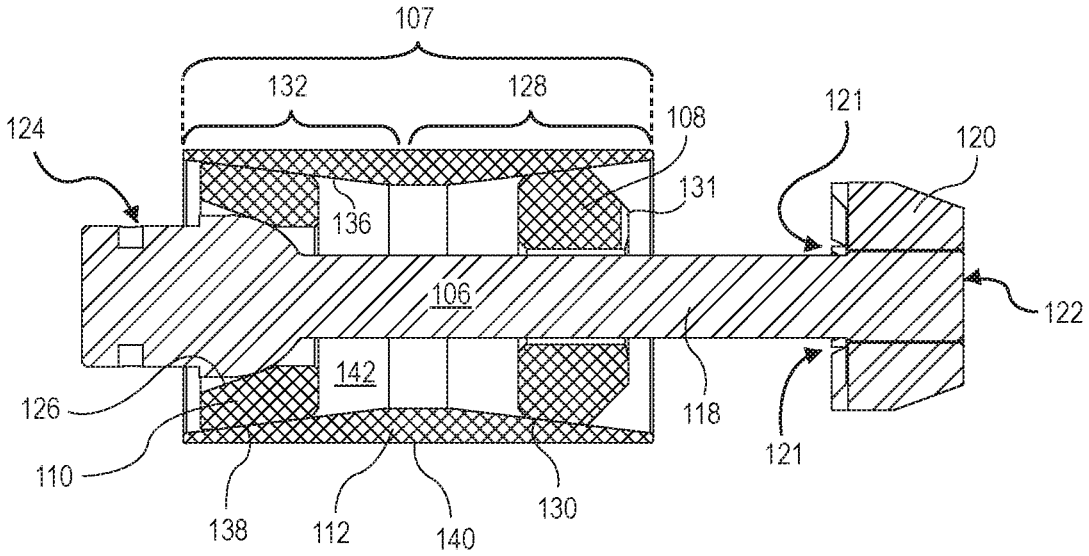
FIG. 4 illustrates a cross-sectional side view of a portion of the downhole tool in the set state after a setting sleeve and the inner body are removed, and the isolation device is disposed in the expandable sleeve in a first position, according to an embodiment.

FIG. 4 illustrates a cross-sectional side view of a portion of the downhole tool 100 after the setting sleeve 102 and the inner body 104 are removed, and the isolation device 106 is disposed in a first position in the expandable sleeve 112, according to an embodiment. In the first position, the second end portion 124 of the isolation device 106 may be disposed adjacent to the upper cone 110. An axial force may be applied in the downhole direction to the second end portion 124 of the isolation device 106 to force the second end portion 124 adjacent to the upper cone 110. The axial force applied to the second end portion 124 of the isolation device 106 may be provided by a pressure in the wellbore uphole of the upper cone 110 and the isolation device 106, such as a pump at the surface. The axial force applied from the isolation device 106 to the upper cone 110 may cause the upper cone 120 to move further into the expandable sleeve 112 (to the right in FIG. 4), thereby further actuating the expandable sleeve 112 radially outward and increasing the gripping force with surfaces of the wellbore. When received into the valve seat 126, the isolation device 106 may isolate or separate a portion of the wellbore uphole of the upper cone 110 and the second end portion 124 of the isolation device 106 from a portion of the wellbore downhole of the upper cone 110 and the isolation device 106. As such, the force applied from the isolation device 106 to the upper cone 110 in the first position may block flow through the bore 142 of the expandable sleeve 112.

Figure 5:
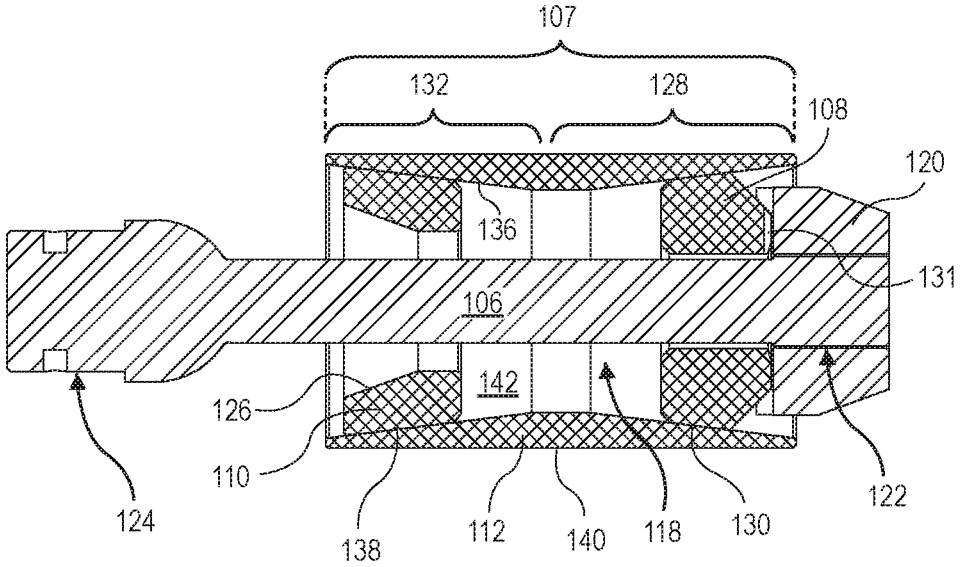
FIG. 5 illustrates a cross-sectional side view of a portion of the downhole tool in the set state after the setting sleeve and the inner body are removed, and the isolation device is disposed in the expandable sleeve in a second position, according to an embodiment.

FIG. 5 illustrates a cross-sectional side view of a portion of the downhole tool 100 after the setting sleeve 102 and the inner body 104 are removed, and the isolation device 106 is disposed in a second position in the expandable sleeve 112, according to an embodiment. In the second position, the head 120 of the isolation device 106 may be disposed adjacent to the lower cone 108. The second end portion 124 of the isolation device 106 may not provide a fluid seal with the upper cone 110. In at least one embodiment, to actuate the portion of the isolation device 106 to the second position, an axial force may be applied to the head 120 of the isolation device 106 in an uphole direction to force the head 120 adjacent the lower cone 108. In another embodiment, an axial force may be applied to the second end portion 124 of the isolation device 106 in the uphole direction (to the left in FIG. 5) to move the second end portion 124 away from the upper cone 110 and actuate the portion of the isolation device 106 to the second position.

The axial force applied to the head 120 and/or the second end portion 124 of the isolation device 106 in the uphole direction may be provided by a pressure in the wellbore downhole of (e.g., below) the lower cone 108, the upper cone 110, the isolation device 106, or any combination thereof. The actuation of the portion of the isolation device 106 to the second position may provide fluid communication through the bore 142 of the expansion sleeve 112. For example, in the second position, fluid downhole of the lower cone 108 may flow to and through the bore 142 of the expansion sleeve 112 through the respective grooves 121, 131 formed in the head 120 and the lower cone 108, as the grooves 121, 131 prevent a fluid-tight interface between an upper, axially-facing surface of the head 120 and a lower, axially-facing surface of the lower cone 130.

Figure 6:
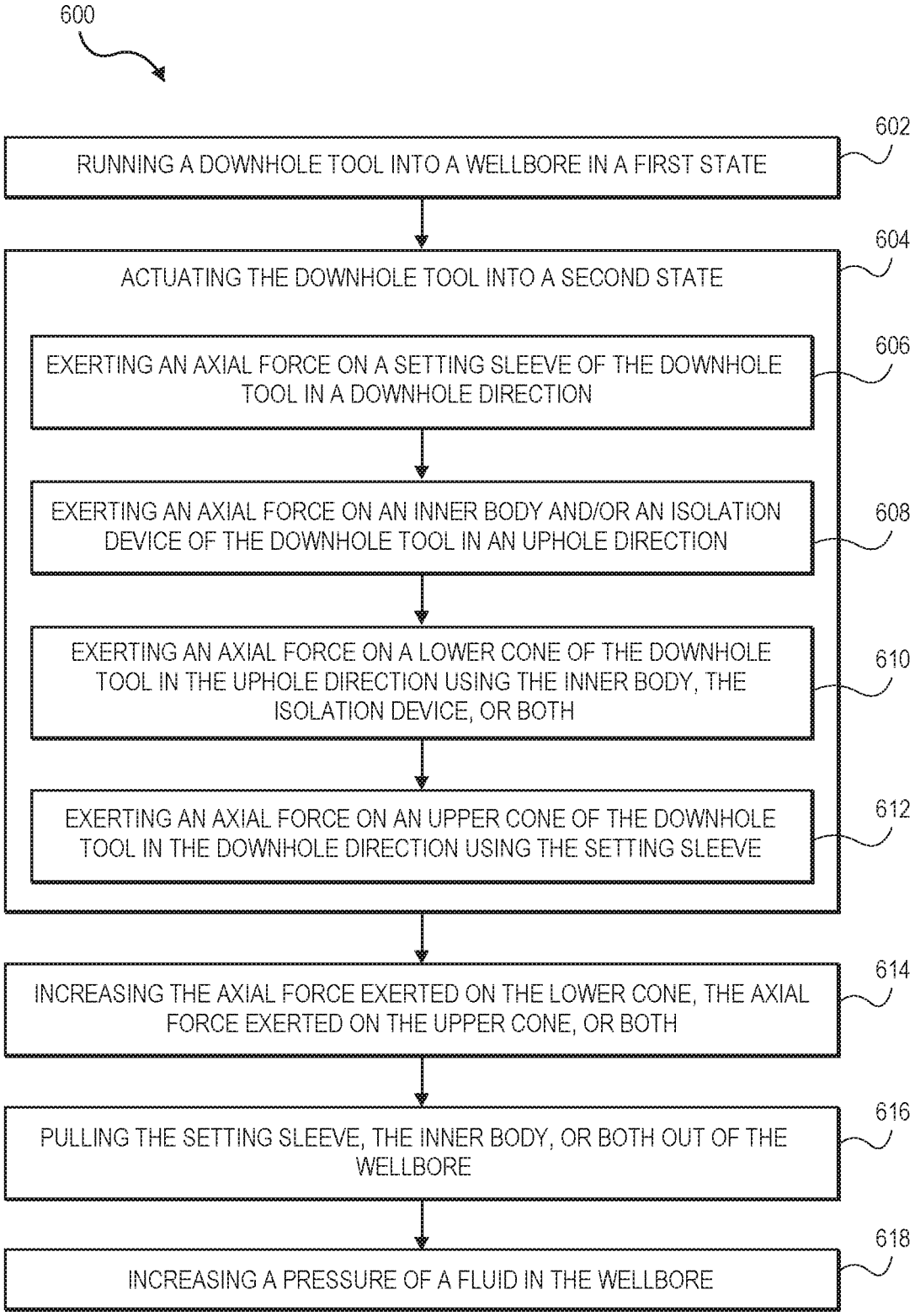
FIG. 6 illustrates a flowchart of a method for plugging a wellbore with the downhole tool, according to an embodiment.

FIG. 6 illustrates a flowchart of a method 600 for plugging a wellbore with a downhole tool, according to an embodiment. The method 600 may be employed using one or more embodiments of the downhole tool 100 discussed above with reference to FIGS. 1-5. However, in other embodiments, the method 600 may be employed to use other downhole tools, and thus may not be limited to any particular structure.

The method 600 may include running the downhole tool 100 into a wellbore in the first state, as at 602. This is shown in FIG. 1. Once the downhole tool 100 is in the desired position in the wellbore, the method 600 may also include actuating the downhole tool 100 into the second state, as at 604. This is shown in FIG. 2.

Actuating the downhole tool 100 into the second state may include exerting an axial force on the setting sleeve 102 in a downhole direction, as at 606. Actuating the downhole tool 100 into the second state may also include exerting an axial force on the inner body 104 and/or the isolation device 106 in the uphole direction, as at 608. The axial forces at 606 and 608 may be exerted simultaneously. The axial forces at 606 and 608 may cause the first shearable members 114A, 114B to break, thereby decoupling the setting sleeve 102 from the inner body 104. This is also shown in FIG. 2.

After the setting sleeve 102 decouples from the inner body 104, actuating the downhole tool 100 into the second state may further include exerting an axial force on the lower cone 108 in the uphole direction using the inner body 104, the isolation device 106, or both, as at 610. This may cause the lower cone 108 to move toward the upper cone 110, which causes the lower portion 128 of the sleeve 112 to expand radially outward. When the isolation device 106 (e.g., the head 120) is in contact with the lower cone 108 and/or exerting the axial force on the lower cone 108, fluid flow through the downhole tool 100 (e.g., through the lower cone 108 and/or the head 120) may be permitted via the one or more channels 121 in the isolation device 106 (e.g., the head 120), the one or more channels 131 in the lower cone 108, or both. Actuating the downhole tool 100 into the second state may also include exerting an axial force on the upper cone 110 in the downhole direction using the setting sleeve 102, as at 612. This may cause the upper cone 110 to move toward the lower cone 108, which causes the upper portion 132 of the sleeve 112 to expand radially outward. In other words, the lower cone 108 and the upper cone 110 may be adducted together to cause the sleeve 112 to expand radially outward. When expanded radially outward, the sleeve 112 may contact the outer tubular (e.g., a casing, a liner, or the wall of the wellbore) and may secure the downhole tool 100 axially in place in the outer tubular.

The method 600 may also include increasing the axial force exerted on the lower cone 108, the axial force exerted on the upper cone 110, or both, as at 614. The increased axial force(s) may cause the second shearable members 116A, 116B to break, thereby decoupling the inner body 104 from the isolation device 106. This is shown in FIG. 3. After the inner body 104 is decoupled from the isolation device 106, the method 600 may also include pulling the setting sleeve 102, the inner body 104, or both out of the wellbore, as at 616.

The method 600 may also include increasing a pressure of a fluid in the wellbore, as at 618. The pressure of the fluid may be increased when the downhole tool 100 is in the second state. For example, the pressure of the fluid may be increased when the sleeve 112 is expanded radially outward such that the downhole tool 100 is secured in place within the outer tubular. The pressure of the fluid may be increased above the downhole tool 100. For example, the pressure of the fluid may be increased by a pump at the surface. The increased pressure may cause the isolation device 106 to move in the downhole direction with respect to the lower cone 108, the upper cone 110, and/or the sleeve 112, as shown in FIG. 4. The isolation device 106 may contact/engage the valve seat 126 of the upper cone 110, which may substantially prevent fluid flow through the downhole tool 100 in the downhole direction.

If the pressure of the fluid below the downhole tool 100 becomes greater than the pressure of the fluid above the downhole tool 100, then the isolation device 106 may move in the uphole direction with respect to the lower cone 108, the upper cone 110, and/or the sleeve 112, as shown in FIG. 5. The isolation device 106 (e.g., the head 120) may contact/engage the lower cone 108. However, as mentioned above, the channels 121 and/or the channels 131 may permit fluid flow through the downhole tool 100 (e.g., through the lower cone 108 and/or the head 120) in the uphole direction when the isolation device 106 is in contact with the lower cone 108.

The present disclosure has been described with reference to exemplary embodiments. Although a limited number of embodiments have been shown and described, it will be appreciated by those skilled in the art that changes may be made in these embodiments without departing from the principles and spirit of the preceding detailed description. It is intended that the present disclosure be construed as including all such modifications and alterations insofar as they come within the scope of the appended claims or the equivalents thereof.

What is claimed is:

1. A downhole tool, comprising:

an expandable sleeve comprising a lower portion and an upper portion;

a lower cone positioned at least partially within the lower portion of the expandable sleeve;

an upper cone positioned at least partially within the upper portion of the expandable sleeve, wherein the lower and upper cones are configured to expand the respective lower and upper portions of the expandable sleeve radially outward when the lower and upper cones are adducted toward one another; and an isolation device extending through the expandable sleeve, the lower cone, and the upper cone, wherein a first end portion of the isolation device is configured to exert a force on the lower cone to pull the lower cone towards the upper cone and thereby actuate the lower portion of the expandable sleeve radially outward, wherein a second end portion of the isolation device is configured to exert a force on the upper cone to push the upper cone towards the lower cone and thereby actuate the upper portion of the expandable sleeve radially outward, and wherein the isolation device is configured to engage the upper cone so as to block fluid flow therethrough in at least one direction.

2. The downhole tool of claim 1, wherein the first end portion of the isolation device comprises a head that defines a plurality of channels extending radially on an axially facing surface thereof, and wherein the axially facing surface of the head is configured to engage the lower cone.

3. The downhole tool of claim 1, wherein the upper cone comprises a valve seat, and wherein the second end portion of the isolation device is sized and shaped to interface with the valve seat of the upper cone to block fluid flow therethrough in the at least one direction.

4. The downhole tool of claim 3, wherein the second end portion of the isolation device is semispherical.

5. The downhole tool of claim 1, further comprising:

a setting sleeve configured to exert a force on the upper cone to push the upper cone towards the lower cone and thereby actuate the upper portion of the expandable sleeve radially outward; and an inner body coupled to the setting sleeve and the isolation device.

6. The downhole tool of claim 5, wherein the setting sleeve is coupled to the inner body via a first shearable member, and wherein the inner body is coupled to the isolation device via a second shearable member.

7. A downhole tool, comprising:

an expandable sleeve comprising a lower portion and an upper portion;

a lower cone positioned at least partially within the lower portion of the expandable sleeve;

an upper cone positioned at least partially within the upper portion of the expandable sleeve; and an isolation device extending through the expandable sleeve, the lower cone, and the upper cone, wherein:

the isolation device is configured to contact the lower cone, the upper cone, or both to cause the expandable sleeve to expand radially outward;

fluid flow through the expandable sleeve is permitted when the isolation device is in contact with the lower cone; and fluid flow through the expandable sleeve is substantially prevented when the isolation device is in contact with the upper cone.

8. The downhole tool of claim 7, wherein the upper portion of the isolation device is configured to exert the axial force on the upper cone after the lower portion of the isolation device has exerted the axial force on the lower cone, such that the upper portion and the lower portion do not exert the axial forces simultaneously.

9. The downhole tool of claim 7, wherein the lower cone, the lower portion of the isolation device, or both define one or more channels that permit fluid flow through the expandable sleeve when the lower portion of the isolation device is in contact with the lower cone.

10. The downhole tool of claim 7, further comprising:

a setting sleeve; and an inner body positioned at least partially within the setting sleeve, wherein the setting sleeve is coupled to the inner body via a first shearable member, and wherein the inner body is coupled to the isolation device via a second shearable member.

11. The downhole tool of claim 10, wherein the first shearable member is configured to break, thereby decoupling the setting sleeve from the inner body, in response to a first force, wherein the second shearable member is configured to break, thereby decoupling the inner body from the isolation device, in response to a second force, and wherein the first force is less than the second force.

12. The downhole tool of claim 7, wherein a lower portion of the isolation device is configured to exert an axial force on the lower cone that moves the lower cone toward the upper cone, which causes the lower portion of the expandable sleeve to expand radially outward.

13. The downhole tool of claim 12, wherein an upper portion of the isolation device is configured to exert an axial force on the upper cone that moves the upper cone toward the lower cone, which causes the upper portion of the expandable sleeve to expand radially outward.

14. A method for plugging a wellbore, comprising:

running a downhole tool into the wellbore in a first state, wherein the downhole tool comprises:

an expandable sleeve;

a lower cone and an upper cone positioned at least partially within the expandable sleeve; and an isolation device extending through the expandable sleeve, the lower cone, and the upper cone;

actuating the downhole tool into a second state in the wellbore, wherein actuating the downhole tool into the second state comprises adducting the lower and upper cones toward one another in the expandable sleeve, thereby causing the expandable sleeve to expand radially outward; and increasing a pressure of a fluid in the wellbore above the downhole tool when the downhole tool is in the second state, thereby causing the isolation device to engage the upper cone and substantially prevent fluid flow though the downhole tool in a downhole direction.

15. The method of claim 14, wherein the downhole tool further comprises a setting sleeve and an inner body positioned at least partially within the setting sleeve, and wherein actuating the downhole tool into the second state further comprises simultaneously:

exerting an axial force on the setting sleeve in the downhole direction; and exerting an axial force on the inner body in an uphole direction, thereby causing the setting sleeve to decouple from the inner body.

16. The method of claim 15, wherein, after the setting sleeve decouples from the inner body, adducting the lower and upper cones toward one another in the expandable sleeve comprises simultaneously:

exerting an axial force on the lower cone using the isolation device that moves the lower cone toward the upper cone, thereby causing a lower portion of the expandable sleeve to expand radially outward; and exerting an axial force on the upper cone using the setting sleeve that moves the upper cone toward the lower cone, thereby causing an upper portion of the expandable sleeve to expand radially outward.

17. The method of claim 16, wherein, when the isolation device exerts the axial force on the lower cone, fluid flow through the downhole tool is permitted via one or more channels in the isolation device, the lower cone, or both.

18. The method of claim 16, wherein, after the lower and upper cones are adducted toward one another, the method further comprises:

increasing the axial force exerted on the lower cone, the axial force exerted on the upper cone, or both, thereby causing the inner body to decouple from the isolation device; and pulling the setting sleeve, the inner body, or both out of the wellbore.

19. A downhole tool, comprising:

an expandable sleeve comprising a lower portion and an upper portion;

a lower cone positioned at least partially within the lower portion of the expandable sleeve;

an upper cone positioned at least partially within the upper portion of the expandable sleeve, wherein the lower and upper cones are configured to expand the respective lower and upper portions of the expandable sleeve radially outward when the lower and upper cones are adducted toward one another;

a setting sleeve configured to exert a force on the upper cone to push the upper cone towards the lower cone and thereby actuate the upper portion of the expandable sleeve radially outward;

an isolation device extending through the expandable sleeve, the lower cone, and the upper cone, wherein the isolation device is configured to engage the upper cone so as to block fluid flow therethrough in at least one direction; and an inner body coupled to the setting sleeve and the isolation device.

* * * * *